United States Patent [19]

Bornand

[11] 4,338,124

[45] Jul. 6, 1982

[54] METHOD OF PURIFICATION OF ALUMINIUM MELTS

[75] Inventor: Jean D. Bornand, Sierre, Switzerland

[73] Assignee: Swiss Aluminium Ltd., Chippis, Switzerland

[21] Appl. No.: 199,730

[22] PCT Filed: Nov. 19, 1979

[86] PCT No.: PCT/CH79/00145

§ 371 Date: Jul. 21, 1980

§ 102(e) Date: Jul. 17, 1980

[87] PCT Pub. No.: WO80/01082

PCT Pub. Date: May 29, 1980

[30] Foreign Application Priority Data

Nov. 21, 1978 [CH] Switzerland ..... 11914/78

[51] Int. Cl.[3] ..... C22B 23/06

[52] U.S. Cl. ..... 75/68 R; 75/93 E

[58] Field of Search ..... 75/93 E, 68 R

[56] References Cited

U.S. PATENT DOCUMENTS

| | | | |
|---|---|---|---|
| 2,160,812 | 6/1939 | Alden et al. | 75/93 E |
| 2,380,863 | 7/1945 | Nelson et al. | 75/93 E |
| 3,144,323 | 8/1964 | Watson et al. | 75/68 R |
| 3,767,382 | 10/1973 | Bruno et al. | 75/68 R |
| 3,958,981 | 5/1976 | Forberg et al. | 75/68 R |
| 3,975,187 | 8/1976 | Kibby | 75/68 A |

*Primary Examiner*—M. J. Andrews

*Attorney, Agent, or Firm*—Bachman and LaPointe

[57] ABSTRACT

When optimizing the conventional purification methods, by gas, of aluminum in a molten state, a negative effect of the temperature has been revealed surprisingly when using a mixture of noble gases and carbon dioxide. In the same way, it has been proved inadequate to use concentrations of carbon dioxide higher than 10% in volume. It is therefore proposed to use, at a temperature comprised between 730° and 780° C., a gaseous mixture comprised of at least an inert carrier gas and of 4 to 10% in volume of carbon dioxide in a ratio of 0.4 to 1.0 $Nm^3$ per ton of molten material. The method is also appropriate for continuous and discontinuous operation plants. In the first case an optimum effect of the stay time for the molten particles of three minutes should be provided, whereas a total time of one hour should be provided in the second case. This method allows, supposing a pseudo-1 kinetic order, to reach a speed constant of 5.3 for sodium, 4.9 for lithium and $2.5\times10^{-4}$ $sec^{-1}$ for hydrogen, which makes the quality of the method vary with the composition of the alloy to be purified.

7 Claims, 6 Drawing Figures

METHOD OF PURIFICATION OF ALUMINIUM MELTS

BACKGROUND OF THE INVENTION

The invention relates to a method of purification of a melt of aluminum and its alloys by introduction of an active gas mixture at atmospheric pressure.

One of the usual techniques in the aluminum industry has consisted for a long time in passing gas mixtures through melts of aluminum and its alloys, in order to remove from them dissolved gases, especially hydrogen, as well as metallic impurities, especially traces of alkali metals and alkaline earth metals, and at the same time to free the metal from non-metallic inclusions, namely oxides. One of these methods, generally termed gas treatment or degassing employs generally pure chlorine gas and is expensive, in as much as it requires large quantities of this gas and leads to a loss of aluminum in the form of volatile aluminum chloride. This method brings with it undesired working conditions, because in it corrosive and poisonous waste gases result. For this reason in the state of the art at various times proposals have been made as to how one can economize in chlorine, in that one carries out the degassing by a gas mixture of chlorine and a non-reactive gas, as for example air or nitrogen, or while one carries out the treatment in an atmosphere of dry air. At the same time it has even been proposed to employ nitrogen alone ($N_2$) as treatment gas.

Furthermore there has been proposed the use either of carbon dioxide ($CO_2$) or carbon monoxide (CO) for the treatment of molten magnesium alloys before casting (U.S. Pat. No. 2,380,863). Nevertheless, with aluminum it has been generally assumed that the employment of carbon dioxide would be unsuitable, because this would be reduced partly to free carbon on contact with the aluminum melt, which in turn would react with the aluminum, and produce undesired aluminum carbide, $AlC_3$, (U.S. Pat. No. 2,369,213). For this reason it was surprising and unexpected that, according to the present invention, a significant improvement of the existing method is achieved, and at the same time the undesired side effects could be extensively reduced, in that a flushing gas was introduced consisting of carbon dioxide and a non-reactive carrier gas, for example an inert gas.

The object of the present invention accordingly consisted in reducing the content of alkali metals and alkaline earth metals, hydrogen and non-metallic inclusions in melts of aluminum and its alloys as far as possible, by a flushing gas treatment, and at the same time to keep the undesired side effects of this flushing gas treatment as slight as possible. In particular the formation of dross and loss of metal with it should be minimized. At the same time the energy costs should be held as low as possible, that is to say the duration of the flushing gas treatment should be minimized and the normal operating temperature of melt treatment of about 770° C. should not be exceeded. Finally, the material costs of the treatment, especially the costs for the flushing gas and possibly for a charge of filter granulate should be minimized and the undesired toxic properties of chlorine gas should be excluded.

SUMMARY OF THE INVENTION

This object was solved by a flushing gas treatment which is characterized in that, a gas mixture consisting of at least one non-reactive gas as carrier gas and 4 to 10% by volume carbon dioxide is introduced in a concentration of 0.4 to 1.0 normal cubic meters per ton of melt treated, at a melt temperature of 730° to 780° C. while the contact time of the individual melt particles lies between 3 minutes and 1 hour.

In one way of performing the invention, the flushing gas treatment takes place as a discontinuous (batch) operation. Throughout the entire duration of the treatment, the metal melt is in a holding furnace and the gas mixture is introduced into the melt by means of lances. Then the residence time of the individual melt particles amounts to between 30 minutes and 1 hour. In the other way of performing, the metal melt flows through a continuous filter during treatment in a continuous operation. Then the rate of flow of the melt amounts preferably to 20 tons per hour and the individual melt particles correspondingly are in contact with the gas mixture during a residence time of 3 to 10 minutes. This latter gas mixture is then preferably introduced through porous inlet blocks in the floor of the continuous filter, and, for example, in a device with eleven of such inlet blocks an inlet pressure for the gas mixture of 1.5 to 2.5 bar is required. On the grounds of cost it has proved good to use as carrier gas at least partly argon, which is relatively cheap.

DETAILED DESCRIPTION

In judging the quality of the flushing gas treatment relative to the elimination of impurities from the aluminum melt one starts from the fact that one is operating with such a high excess of one reaction component (flushing gas) that its concentration during the reaction can vary only insignificantly. It is therefore to be expected that the reaction exhibits kinetics of pseudo 1st order and the concentration (A) of the other reaction component (impurity) follows a time law of the form $$(A)=(A)_o \cdot e^{-kt} \quad (1)$$

(see in this connection A. A. FROST/R. G. PEARSON, Kinetik und Mechanismen homogener chemischer Reaktionen, Weinheim/Bergstrasse 1964, p. 11).

In the melt treatment in practice, the starting concentration $(A)_o$ of the impurity and, on economic grounds, also the duration (t) of the experiment function as more or less invariable basic conditions and the velocity constant attainable with these basic conditions by variation of the reaction parameters $$k=(1/t)\ \ln\ (A)_o/(A) \quad (2)$$

makes possible a correct prediction of the attainable final concentration of a given impurity and thus provides a direct measure for the quality of the method employed in a particular case.

Figure 1A:
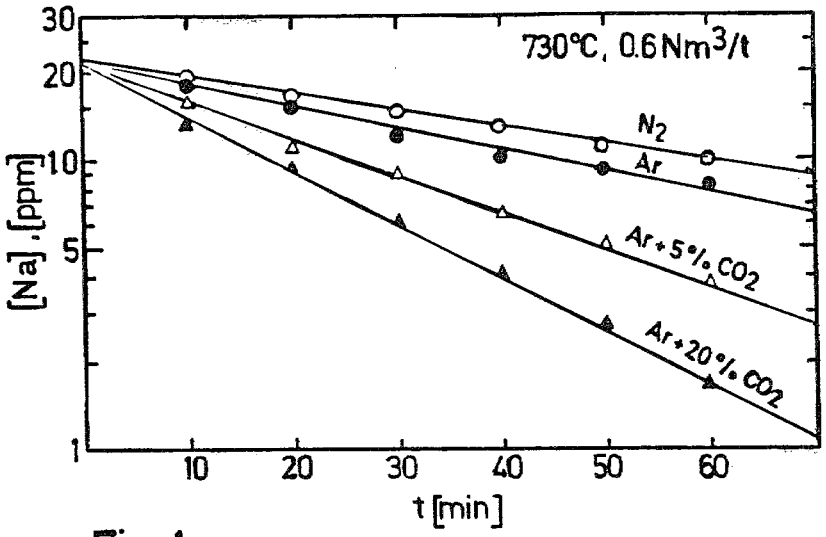
FIGS. 1*a* and 1*b* are graphs showing the effect of different degassing compositions on the sodium and hydrogen contents of a melt of aluminum.
Figure 1B:
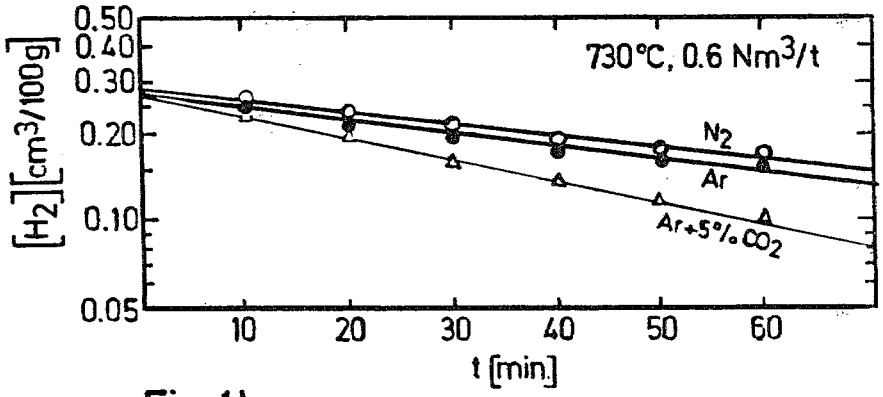

With employment of different compositions of flushing gas in experiment, the supposition that the reaction has kinetics of pseudo 1st order is confirmed, inasmuch as the values of velocity constant k obtained in fact show no dependence at all on time, corresponding to a constant slope of the curve of elimination in FIG. 1. The velocity constants k calculated for a melt temperature of 730° C. and a flushing gas concentration of 0.6 $Mn^3$ per ton then had the result that a mixture of argon with 5% carbon dioxide ($CO_2$) had superior elimination properties as compared with nitrogen ($N_2$) and argon (Ar) not only relative to the known impurities sodium and hydrogen, but also relative to the increasingly greater practical significance of contained lithium. Then the values of k vary in dependence on the composition of the melt to be purified, but the effect remains qualitatively the same (Table 1).

TABLE 1

Influence of the flushing gas composition on the velocity constant of the elimination reaction of Na, Li and $H_2$ from aluminum alloys.

Experimental conditions: Melt temperature: 730° C.; Flushing gas concentration: 0.6 $Nm^3/t$; Duration of test: t = 3600 sec.

| Impurity | Flushing Gas | ln $A_o/A$ | K [$sec^{-1}$] |
|---|---|---|---|
| Alloy 1500: | | | |
| Na | $N_2$ | 0.9163 | $2.545 \times 10^{-4}$ |
| | Ar | 1.2039 | 3.344 |
| | Ar + 5% $CO_2$ | 1.8971 | 5.267 |
| Li | $N_2$ | 0.6931 | 1.925 |
| | Ar | 0.9163 | 2.545 |
| | Ar + 5% $CO_2$ | 1.7720 | 4.922 |
| $H_2$ | $N_2$ | 0.5978 | 1.661 |
| | Ar | 0.6931 | 1.925 |
| | Ar + 5% $CO_2$ | 0.9163 | 2.545 |
| Alloy 5300: | | | |
| Na | $N_2$ | 0.5978 | $1.661 \times 10^{-4}$ |
| | Ar | 0.7985 | 2.218 |
| | Ar + 5% $CO_2$ | 1.0598 | 2.916 |
| Li | $N_2$ | 0.2877 | 0.799 |
| | Ar | 0.2877 | 0.991 |
| | Ar + 5% $CO_2$ | 0.4308 | 1.197 |
| $H_2$ | $N_2$ | 0.5108 | 1.419 |
| | Ar | 0.6931 | 1.925 |
| | Ar + 5% $CO_2$ | 0.9163 | 2.545 |

Thus, with the alloy 1500 (99.50 to 99.59% Al) the value of k relative to the elimination of sodium shows an increase of about 100% as compared with nitrogen and about 60% with respect to argon, in contrast only an increase 75% and 30% respectively with the material 5300 (2.8% Mg, 0.3% Mn) which is more highly alloyed with magnesium. Above a magnesium content of 4%, the quality of the method declines. Particularly marked is also the effect relative to the elimination of lithium, which results in an increase in the value of k by 150% and 100% respectively, with the alloy 1500 and 50% and 20% respectively with the alloy 5300. The influence is somewhat less on the elimination of hydrogen, which fluctuates between an increase of k between 30% and 80% (Table 1).

Surprisingly it has appeared in this series of tests that an increase of the content of carbon dioxide above 5% by volume impairs the level of use of $CO_2$ to such an extent that, for example, an increase of the $CO_2$ concentration by four times (to 20%) makes possible only a halving of the attainable final concentration of sodium (2 instead of 4 ppm) (under otherwise unchanged conditions) (FIG. 1-*a*).

For judging the temperature dependence of the elimination reaction one starts from the fact that carbon dioxide reacts with the impurities in question according to the equations:

$$CO_2 + H_2 \rightleftarrows CO + H_2O - 99 \text{ kcal (watergas equilibrium)} \quad (3)$$

and $$CO_2 + 2Na \rightleftarrows CO + Na_2O \quad (4)$$

Both are endothermic reactions, the thermodynamic equilibrium constants of which exhibit a similar response to temperature as that of the known equilibrium of carbon dioxide and carbon (BOUDOUARD equilibrium). In both reactions the equilibrium consequently shifts to the right with rising temperature; thus, for example, the thermodynamic equilibrium constant of equation (3) has at 830° C. a value of 1 and the reaction components at temperatures from 1000° C. are present overwhelmingly in the form of CO and $H_2O$ (Hollemann/Wiberg, Lehrbuch der anorganischen Chemie, 57–70. Edition, Berlin 1964 p 307 f).

If one transfers these thermodynamic items of knowledge into the realm of kinetics, then a positive temperature dependence of the velocity constant k will emerge; if the thermodynamic equilibrium shifts to the right with rising temperature, then, keeping the concentration of $CO_2$ constant, the conversion of the reaction components into the products CO and $Na_2O$, and at the same time the overall speed of the elimination of sodium (or other impurities) should rise (see Frost/Pearson loc.cit.p 22 f).

Figure 2A:
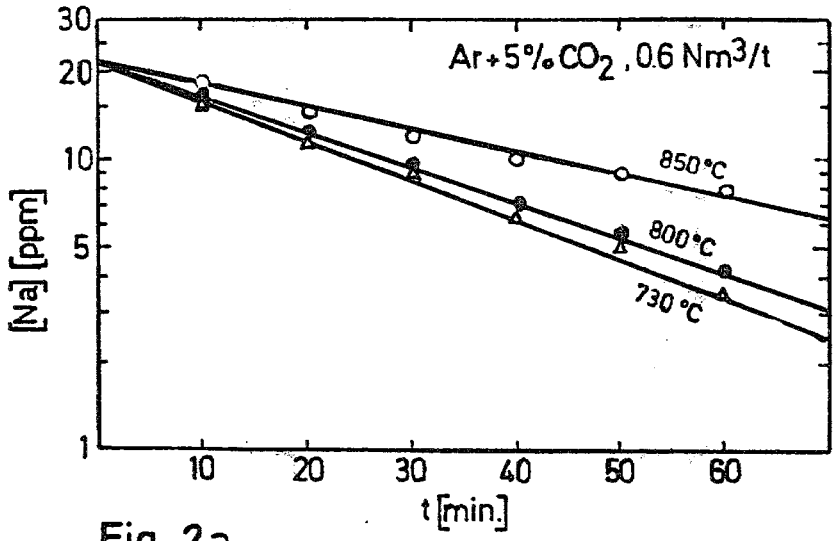
FIGS. 2*a* and 2*b* are graphs showing the effect of melt temperature on the sodium and hydrogen contents of a melt of aluminum.
Figure 2B:
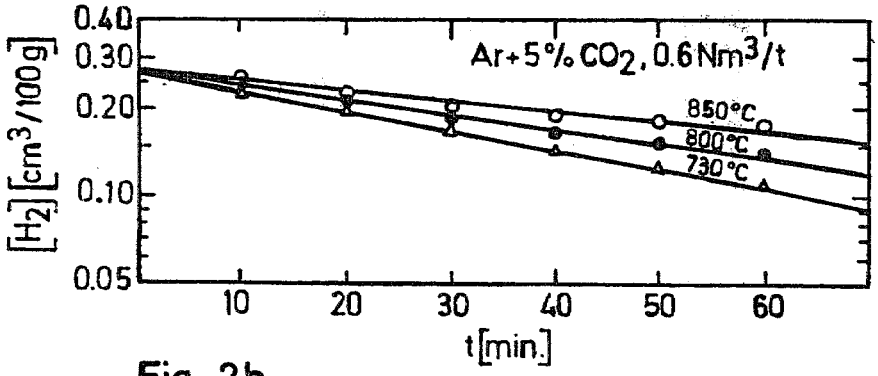

Surprisingly it has now appeared that the velocity constant k of the elimination reaction and at the same time the attainable final concentration A of the individual impurities with the stated constant basic conditions (duration of experiment 1 hour and starting concentration $A_o$ of the impurities), instead of rising with rising temperature as expected, sink in a distinct manner (Table 2). For example if k attains a value of $4.977 \times 10^{-4}$ $sec^{-1}$ on introduction of argon with 5% carbon dioxide with respect to sodium at 730° C., then this value falls to $3.122 \times 10^{-4}$ $sec^{-1}$ at 850° C. The proportions relative to the elimination of hydrogen behave similarly, where the value of k of $2.787 \times 10^{-4}$ $sec^{-1}$ at 730° C. falls to only $1.450 \times 10^{-4}$ $sec^{-1}$ at 850° C. (FIG. 2). To obtain an optimum level of use of $CO_2$ it seems therefore to be inappropriate to work at temperatures which exceed the usual melt temperatures of aluminum melts of 730° C. This result is still less to be expected, since another invention of the applicants has shown that an increase of the reaction temperature above 770° C. very positively influences the quality of flushing gas treatment with flushing gases of other chemical composition (No. 3807/76).

TABLE 2

Influence of the temperature on the velocity constant of the elimination reaction of Na and $H_2$ from aluminum melts Experimental conditions: Flushing gas concentration: 0.6 $Nm^3/t$; Flushing gas composition: Argon + 5% $CO_2$; Duration of test: t = 3600 sec.; Casting alloy 1500 (Al 99.50–Al 99.59)

| Impurity | T °C. | ln $A_o/A$ | K [$sec^{-1}$] |
|---|---|---|---|
| Na | 730 | 1.7918 | $4.977 \times 10^{-4}$ |
| | 800 | 1.6094 | 1.471 |

TABLE 2-continued

Influence of the temperature on the velocity constant of the elimination reaction of Na and $H_2$ from aluminum melts Experimental conditions: Flushing gas concentration: 0.6 $Nm^3/t$; Flushing gas composition: Argon + 5% $CO_2$; Duration of test: t = 3600 sec.; Casting alloy 1500 (Al 99.50–Al 99.59)

| Impurity | T °C. | ln $A_o/A$ | K [$sec^{-1}$] |
|---|---|---|---|
| | 850 | 1.1239 | 3.122 |
| $H_2$ | 730 | 1.0033 | $2.787 \times 10^{-4}$ |
| | 800 | 0.7765 | 2.157 |
| | 850 | 0.5220 | 1.450 |

Figure 3A:
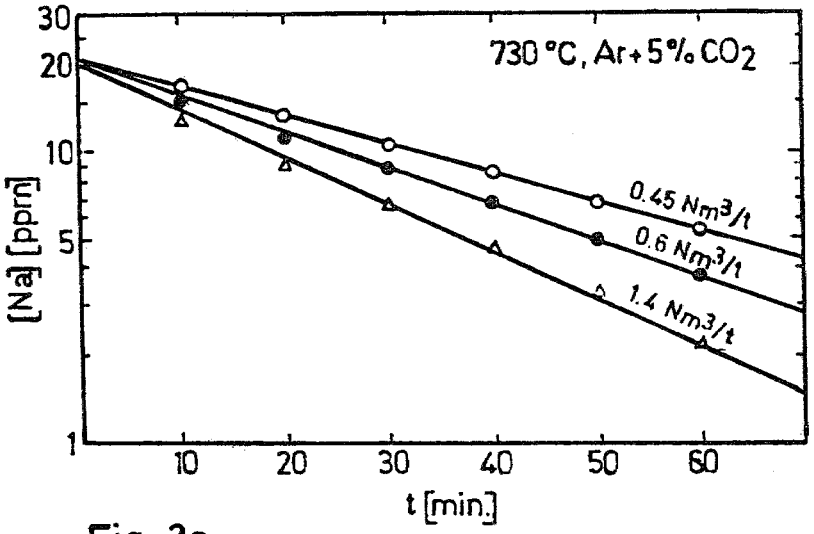
FIGS. 3*a* and 3*b* are graphs showing the effect of the volume of fluxing gas fed to the melt on the sodium and hydrogen contents of a melt of aluminum.
Figure 3B:
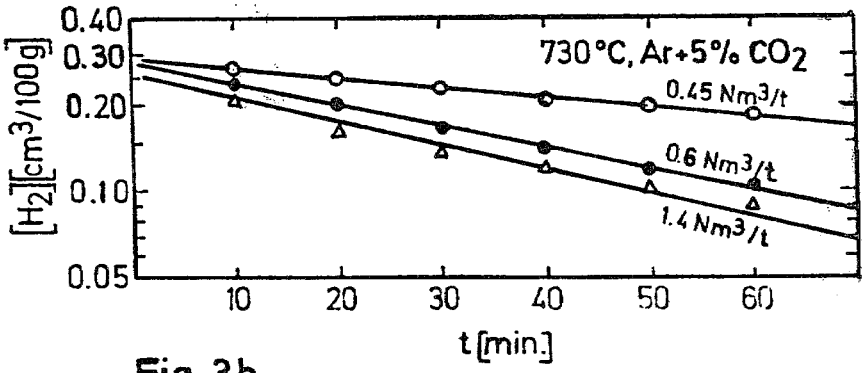

If one varies the concentration of the flushing gas, then of course the result is that the velocity constant k also depends in a notable way on this concentration, to the extent that the statements about the kinetics of the reaction of pseudo 1st order have to be modified accordingly (FIG. 3). Surprisingly it then appears that, at 730° C. with a mixture of argon and 5% $CO_2$, an increase of the flushing gas concentration above a value of 0.6 $Nm^3$ per ton of melt handled impairs the level of use of $CO_2$ to such an extent that an increase of concentration from 0.6 to 1.4 $Nm^3/t$, that is to say by more than twice, only produces an increase of k (and thus a reduction of the final concentration of the relevant impurity) by 35% with sodium and by 12% with hydrogen. For this reason the value of 0.6 $Nm^3/t$ should suitably not be exceeded (Table 3).

For use in industry, the method of flushing gas treatment must be optimized not only relative to the elimination of impurities, but also relative to the undesired formation of dross. The necessary minimization of dross formation can proceed in connection with the following information: whereas with a melt temperature of 730° C. and a flushing gas concentration of 0.6 $Nm^3/t$ an addition of 3% carbon dioxide to argon leads to formation of 3.2 kg dross per ton of treated metal, this value rises with increase of the $CO_2$ concentration to 20% to 5.0 kg/t, that is only by just 60%. With a $CO_2$ concentration of more than 10% by volume in the gas mixture, the rate of use of $CO_2$ is thus impaired from this point of view also; the optimum $CO_2$ concentration then lies within this range between 4 and 6% by volume $CO_2$.

TABLE 3

Influence of the flushing gas concentration on the velocity constant of the elimination reaction of Na and $H_2$ from aluminum melts.

Experimental conditions: Flushing gas composition: Argon + 5% $CO_2$; Reaction temperature: 730° C.; Duration of test: t = 3600 sec.; Casting alloy 1500 (Al 99.50–Al 99.59)

| Impurity | Flushing gas concentration [$Nm^3/t$] | ln $A_o/A$ | K [$sec^{-1}$] |
|---|---|---|---|
| Na | 0.45 | 1.4376 | $3.993 \times 10^{-4}$ |
| | 0.6 | 1.8431 | 5.120 |
| | 1.4 | 2.4849 | 6.903 |
| $H_2$ | 0.45 | 0.4568 | $1.269 \times 10^{-4}$ |
| | 0.6 | 1.0691 | 2.970 |
| | 1.4 | 1.2040 | 3.344 |

As expected, the flushing gas concentration also influences the quantity of dross produced: 0.4 $Nm^3/t$ of a mixture of argon and 5% $CO_2$ at 730° C. produce only 2 kg dross per ton of metal, while this value rises at 1.4 $Nm^3/t$ to nearly three times, namely 5.8 kg per ton. The quantity which keeps itself within the range explored approximately proportional to the concentration of flushing gas and it therefore seems also from this viewpoint to be not suitable to increase it substantially above 0.6 $Nm^3$ per ton of metal treated. In contrast, the temperature dependence of the formation of dross appears to be less distinct: an increase of the reaction temperature from 730° C. to 850° C. at 0.6 $Nm^3/t$ and 5% $CO_2$ in argon brought only an increase of the quantity of dross produced from 3.5 to 5 kg per ton, that is only by 40%. From the viewpoint of formation of dross it therefore appears not suitable to increase the flushing gas concentration to more than 0.6 $Nm^3/t$ and within the flushing gas mixture the $CO_2$ concentration to more than 10% by volume, while the optimum $CO_2$ concentration lies between 4 and 6% by volume. In contrast the choice of the reaction temperature appears from this viewpoint to be less critical.

Relative to the elimination of non-metallic inclusions, the flushing gas treatment with argon as carrier and 5% carbon dioxide appears to be superior to treatment with nitrogen by a factor of 2 to 3, but as almost equivalent to a flushing gas treatment with pure argon or with the significantly dearer argon/freon mixtures.

In the light of these facts the flushing gas treatment according to the invention appears to be the best compromise from all points of view with a melt temperature of 730° C. to 780° C., with a gas mixture consisting of at least one non-reactive gas as carrier gas and 4 to 10% by volume carbon dioxide in a ratio of 0.4 to 1.0 normal cubic meters per ton of melt treated. If for example one accepts a starting concentration of 24 ppm for sodium, 18 ppm for lithium and 0.30 $cm^3$ hydrogen per 100 g metal as well as a duration of flushing gas treatment of 1 hour, then following the method according to the invention, final concentrations are attainable of less than 5 ppm sodium, less than 3 ppm lithium and about 0.10 $cm^3$ hydrogen per 100 g metal, while the quantity of dross formed under these conditions never exceeds the limit regarded as critical of 4 kilograms dross per ton of purified metal.

It has appeared that the invention can be operated as well in continuous as in discontinuous (batch) operation, while one can regard as equivalent conditions a treatment of an individual charge with a flushing gas lance of 1 hour duration or a continuous treatment of the melt in a continuous filter with a flow of 20 tons of melt per hour (corresponding to a residence time of individual melt particles in the zone of flushing gas treatment of about 3 minutes). In an industrial example of use for purification of a melt relatively rich in magnesium (e.g. the casting alloy 5300) the invention permits economies in the gas mixture, the heating costs, and in the quantity of the dross produced as a byproduct.

I claim:

1. A method of purifying a melt of aluminum and its alloys by introducing an active gas mixture into the melt at atmospheric pressure comprising feeding a gas mixture comprising at least one non-reactive gas as a carrier gas and from about 4 to 10% by volume carbon dioxide at a rate of from about 0.4 to 1.0 normal cubic meters per ton of melt treated at a melt temperature of from about 730° to 780° C. for a melt contact time of from about 3 to 60 minutes.

2. A method according to claim 1 including the steps of holding said melt in a holding furnace and introducing said active gas mixture into said melt in said holding furnace by means of lances wherein the contact time of the individual melt particles is from about 30 minutes to 60 minutes.

3. A method according to claim 1 including the steps of feeding said melt through a continuous filter at a flow rate of up to about 20 tons per hour and treating said melt with said active gas mixture as said melt flows wherein the contact time of the individual melt particles is from about 3 minutes to 10 minutes.

4. A method according to claim 1 wherein said carrier gas consists at least in part of argon.

5. A method according to claim 1 wherein said active gas mixture contains 5% by volume carbon dioxide.

6. A method according to claim 1 wherein the aluminum alloy treated contains magnesium as the principal alloying constituent.

7. A method according to claim 1 wherein said aluminum alloy to be treated contains up to about 4% by weight magnesium.

* * * * *